US007670195B2

(12) United States Patent
Atalay

(10) Patent No.: US 7,670,195 B2
(45) Date of Patent: Mar. 2, 2010

(54) DETACHABLE LIGHT SOCKET AND SPECIAL LIGHTING FIXTURE

(75) Inventor: Suavi Atalay, Istanbul (TR)

(73) Assignee: Nova Electrik Sanayi Ve Ticaret A.S., Istanbul (TR)

( * ) Notice: Subject to any disclaimer, the term of this patent is extended or adjusted under 35 U.S.C. 154(b) by 39 days.

(21) Appl. No.: 11/816,675

(22) PCT Filed: Oct. 27, 2005

(86) PCT No.: PCT/TR2005/000062

§ 371 (c)(1),
(2), (4) Date: Aug. 20, 2007

(87) PCT Pub. No.: WO2007/013864

PCT Pub. Date: Feb. 1, 2007

(65) Prior Publication Data

US 2008/0214036 A1 Sep. 4, 2008

(30) Foreign Application Priority Data

Jul. 29, 2005 (TR) ..... A 2004 02892

(51) Int. Cl.
*H01R 24/00* (2006.01)

(52) U.S. Cl. ..... 439/699.2

(58) Field of Classification Search ..... 439/699.2, 439/220, 340, 356, 360, 619, 701; 362/226, 362/389

See application file for complete search history.

(56) References Cited

U.S. PATENT DOCUMENTS

| | | | | |
|---|---|---|---|---|
| 4,141,062 | A * | 2/1979 | Trueblood | 362/400 |
| 4,184,734 | A | 1/1980 | Toorell | |
| 4,781,614 | A * | 11/1988 | Ahroni | 439/391 |
| 5,369,559 | A * | 11/1994 | Hedrick et al. | 362/376 |
| 5,833,357 | A * | 11/1998 | Ting | 362/378 |
| 6,171,135 | B1 * | 1/2001 | Yang | 439/456 |
| 7,387,398 | B2 * | 6/2008 | Yokota | 362/92 |

FOREIGN PATENT DOCUMENTS

| | | | |
|---|---|---|---|
| DE | 29602924 | U1 | 4/1988 |
| DE | 19609547 | A1 | 9/1997 |
| EP | 0684669 | A | 11/1995 |
| FR | 2812977 | A | 2/2002 |

* cited by examiner

*Primary Examiner*—Chandrika Prasad
(74) *Attorney, Agent, or Firm*—Venable, Campillo, Logan & Meaney PC

(57) ABSTRACT

This invention that forms the subject matter of this patent is related to a light socket that may be disassembled and repaired in case of any breakdown, or replaced by a new one that may be fixed to the body of a fridge by means of a special socket due to be used in fridges, at polyurethane isolated cabins.

5 Claims, 4 Drawing Sheets

DETACHABLE LIGHT SOCKET AND SPECIAL LIGHTING FIXTURE

This application claims priority of PCT/TR2006/000062 filed Oct. 27, 2007, which hereby incorporated by reference in its entirety, which claims priority of Turkish Patent Application TR 2004/02892 filed Jul. 29, 2005 which hereby incorporated by reference in its entirety.

BACKGROUND

This invention that forms the subject matter of this patent is related to a light socket that may be fixed to a fridge body by a special socket due to be used in polyurethane-isolated cabins, for instance fridges.

As is known, the lighting sockets are used in coolers (such as fridges, bottle coolers and so on), any sorts of cabins with polyurethane isolation, lighting armatures, linen drying machines and kitchen aspirators. The lighting sockets are used in a way such that: after it is mounted to the total surface as a single part in fridges and similar devices and relevant cables are connected, and then, fixed to the place where the filling material, stuffed in the panel, and (polyurethane) socket take place; in the devices that do not contain any polyurethane cabin, however, it is used in a way by mounting the same to the panel with an extra connection component.

As a result of the mounting of a socket in the polyurethane-panels, it becomes not possible to replace it in case of any breakdown and causes the device to be scraped as a whole, namely it loses the feature of serviceability. Additionally, when the socket is desired to be mounted in different places on the device, then the sockets with various lengths of cables may be required.

SUMMARY

The invention related to the detachable lighting socket that is detachable by means of a special socket can totally overcome this kind of obstacle as well as any other similar ones; the advantage of this is its serviceability since it contains a socket, and in cases where the socket is fixed in different places on the same device, there would be no need to use a different socket and possibility of its replacement in case of any breakdown.

This invention that forms the subject matter of this patent is explained in detail only by way of sampling by mentioning the drawing in the appendix hereinafter and in these drawings:

DETAILED DESCRIPTION

Figure 1:
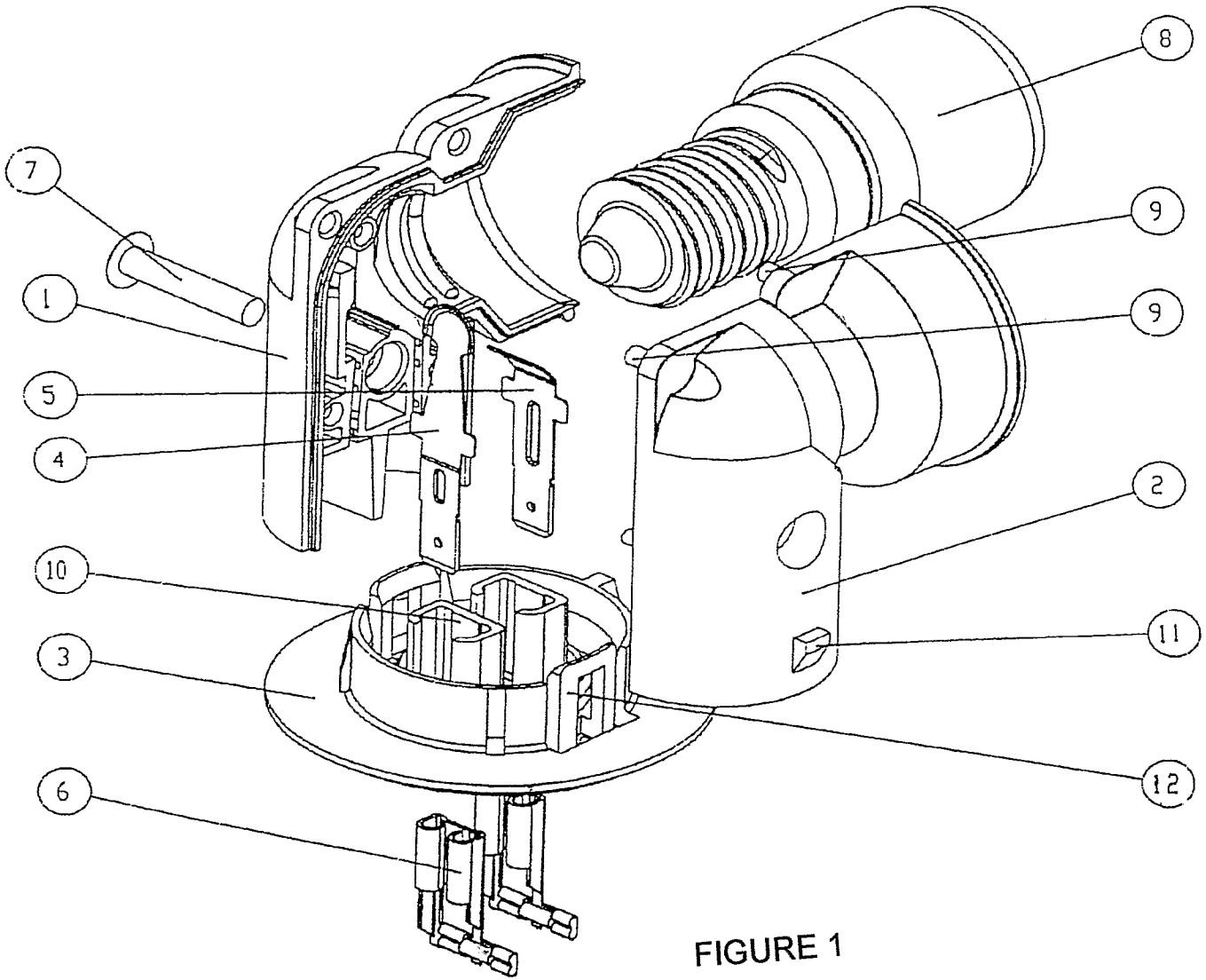
FIG. 1, Open view of the invention.
Figure 2:
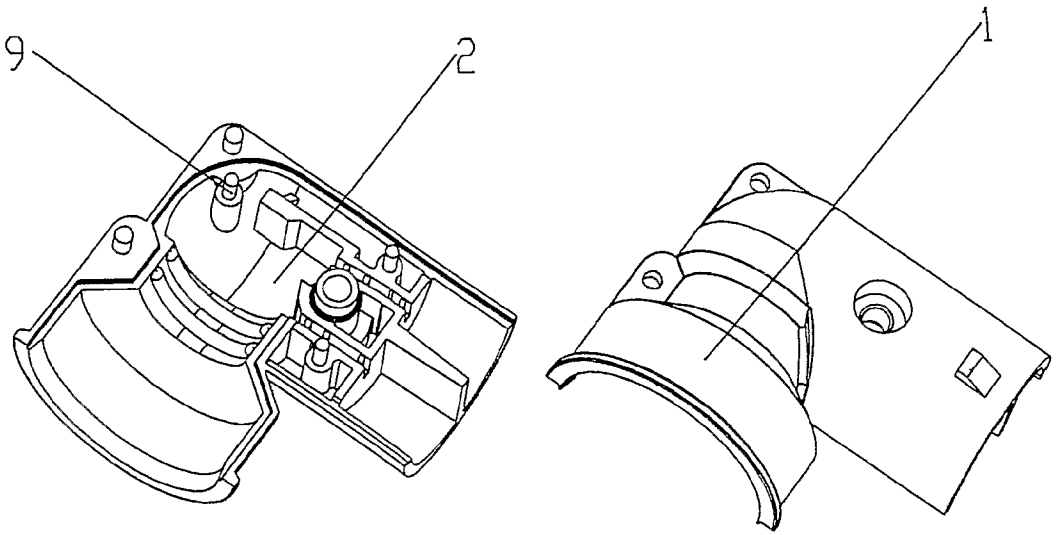
FIG. 2, View of female and male bodies of the invention.
Figure 3:
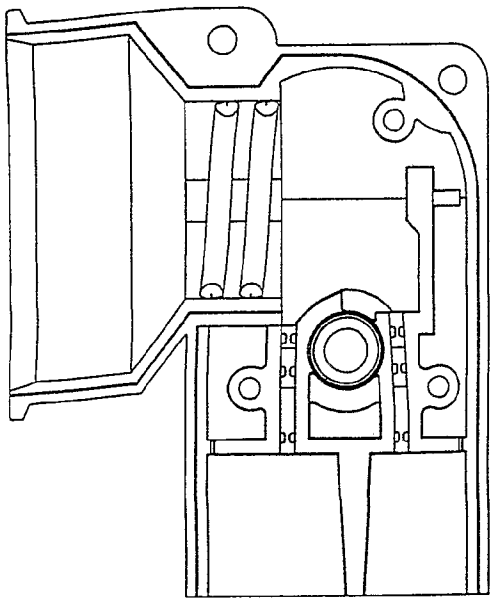
FIG. 3, Cross-section view of the invention.
Figure 5:
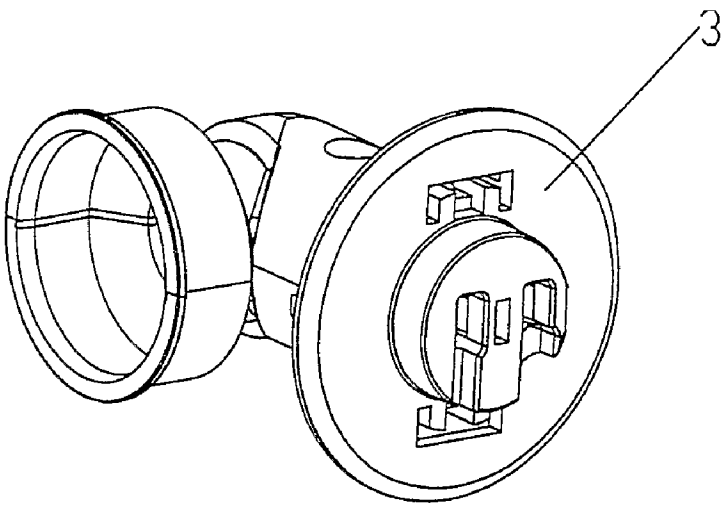
FIG. 5, Mounted perspective view of the invention from below.
Figure 4:
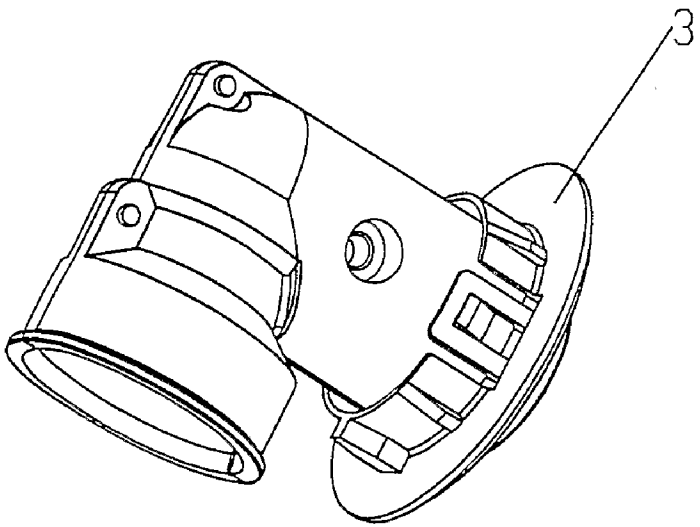
FIG. 4, Mounted perspective view of the invention.
Figure 6:
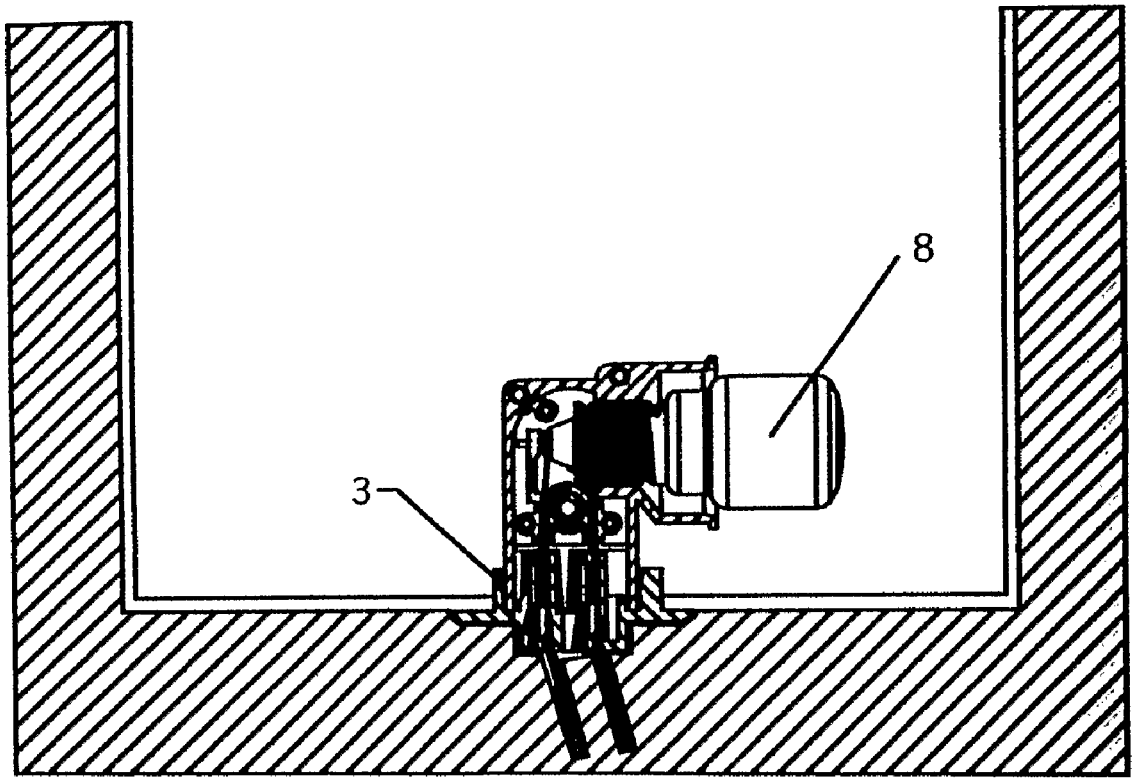
FIG. 6, View of the invention, mounted on the device.

The lighting socket being detachable through a Special Socket and forms the subject matter of the patent is numbered, as indicated in the attached pictures and given together with their names as follows:

| NO | PART NAME |
|---|---|
| 1 | Female body |
| 2 | Male body |
| 3 | Socket |
| 4 | Central contact |
| 5 | Side contact |
| 6 | Female terminal |
| 7 | Rivet |
| 8 | Lighting lamp |
| 9 | Integrated pin |
| 10 | Female terminal housing |
| 11 | Claws |

This patent generally consists of a female body (1) that may be connected to each other with a rivet (7) and a male body (2), and a socket (3) that is inserted in these bodies (1, 2) through claws (11) on the latter, and female terminals (6), ˆinserted into the female terminal housing (10) on the socket (3) and then, a central contact (4) and side contact (5), inserted into these female terminals (6).

The assembly method of the invention that forms the subject matter of this patent can be explained as follows: First of all, the central contact (4) and side contact (5) are fixed into the housings on the female (1) and male bodies (2). After having centered the female (1) and male bodies (2) into each other through integrated pins (9), they are fixed to each other by rivets (7).

The integrated pins (9) at this point ensure the centering process. These bodies (1, 2) are combined with each other by welding. Then, the female terminals (6) are inserted into suitable housings on the socket (3) and may be connected to these female terminals (6) through a cable at a requested length. After having fixed the socket (3) so connected on the requested device, it will be possible to insert these bodies (1, 2) into the socket (3) by the insertion of these claws (11) into the housings on the bodies (1, 2) and be detachable easily when requested. Then it may be likely to fix a lighting lamp (8) at the screwed-section within the lighting socket that is fixed in this manner.

The most important point herein is the possibility of fixing the socket (3) on the device separately from the bodies (1, 2), and attachable and detachable characteristics of these bodies (1, 2) so mounted to each other on the socket (3). In this way, it becomes possible to detach the bodies (1, 2) from the socket (3) in case of any breakdown and to remove the problem or make a replacement without causing any trouble on the device.

Another feature of the invention is the possibility of use of the same on different locations on the device exactly in the same manner without making any changes on the same socket (3) and lighting fixture.

The bodies (1, 2) of the invention are manufactured at the market by the currently known production methods that are carried out by plastic injection and metal chitting molds.

The invention claimed is:

1. A detachable light socket comprising female (1) and male bodies (2) having claws, wherein the female and male bodies are combined by rivets (7) after having centered to each other by integrated pins (9) and a socket (3) inserted into these female and male bodies (1,2) through the claws (11), and female terminals (6) that are inserted into female terminal housings (10) on the socket (3), and central (4) and side contacts (5) that are inserted into these female terminals (6).

2. The detachable light socket of claim 1 wherein the female terminals (6) are characterized by their insertion into the female terminal housings (10) on the socket (3).

3. The detachable light socket of claim 2 wherein the central (4) and side contacts (5) are characterized by their insertion into the housings on the female (1) and male bodies.

4. The detachable light socket of claim 1 wherein the integrated pins (9) are characterized by their locations on the male body (2).

5. The detachable light socket of claim 1 wherein the claws (11) are characterized by the availability of the socket (3) and their insertion into the housings on the female (1) and male bodies.

* * * * *